US008176889B2

(12) United States Patent
Fukuda et al.

(10) Patent No.: US 8,176,889 B2
(45) Date of Patent: May 15, 2012

(54) INTAKE MANIFOLD FOR ENGINE

(75) Inventors: Shojiro Fukuda, Tochigi (JP); Takahiro Taira, Wako (JP)

(73) Assignees: Keihin Corporation, Tokyo (JP); Honda Motor Co., Ltd., Tokyo (JP)

( * ) Notice: Subject to any disclaimer, the term of this patent is extended or adjusted under 35 U.S.C. 154(b) by 727 days.

(21) Appl. No.: 12/246,072

(22) Filed: Oct. 6, 2008

(65) Prior Publication Data

US 2009/0133658 A1 May 28, 2009

(30) Foreign Application Priority Data

Oct. 5, 2007 (JP) ..... 2007-262236

(51) Int. Cl.
*F02M 35/10* (2006.01)

(52) U.S. Cl. ..... 123/184.21; 123/184.42; 123/184.24; 123/184.27; 123/184.47; 123/184.57; 123/184.59

(58) Field of Classification Search ..... 123/184.24, 123/184.22, 184.23, 184.27, 184.37, 184.52, 123/184.61
See application file for complete search history.

(56) References Cited

U.S. PATENT DOCUMENTS

| | | | | |
|---|---|---|---|---|
| 4,014,994 | A * | 3/1977 | Magnaghi et al. | 424/123 |
| 4,104,994 | A * | 8/1978 | Phillips | 123/73 R |
| 4,183,332 | A * | 1/1980 | Hofbauer et al. | 123/184.42 |
| 5,537,965 | A * | 7/1996 | Topfer et al. | 123/184.42 |
| 5,887,560 | A * | 3/1999 | Kobayashi | 123/184.21 |
| 5,970,939 | A * | 10/1999 | Motosugi et al. | 123/184.21 |
| 6,539,907 | B2 * | 4/2003 | Ino et al. | 123/184.55 |
| 6,644,260 | B2 * | 11/2003 | Tsukii et al. | 123/184.42 |
| 6,647,940 | B2 * | 11/2003 | Wada et al. | 123/184.21 |
| 7,082,915 | B2 * | 8/2006 | Tanikawa et al. | 123/184.42 |
| 7,107,683 | B2 * | 9/2006 | Arai et al. | 29/888.4 |
| 7,124,727 | B2 * | 10/2006 | Kogawa et al. | 123/195 R |
| 2003/0010309 | A1 * | 1/2003 | Tsukii et al. | 123/184.42 |

FOREIGN PATENT DOCUMENTS

| | | |
|---|---|---|
| JP | 2002-168153 A | 6/2002 |
| JP | 2002-339816 A | 11/2002 |
| JP | 2002-361745 A | 12/2002 |
| JP | 2003-262164 | 9/2003 |
| JP | 2004-308546 A | 11/2004 |

* cited by examiner

*Primary Examiner* — Noah Kamen
*Assistant Examiner* — Long T Tran
(74) *Attorney, Agent, or Firm* — Arent Fox LLP

(57) ABSTRACT

An intake manifold for an engine includes a plurality of intake distribution pipes arranged in a side-by-side relation to one another; an intake inlet pipe provided in an end wall and arranged in a direction of the intake distribution pipes; a surge chamber provided inside the intake manifold, and providing communication between the intake inlet pipe and the intake distribution pipes; and an intake guide wall provided integrally with the intake manifold. The intake guide wall extending in the direction in which the intake distribution pipes are arranged. One surface of the intake guide wall is smooth-and-flat and the other side surface of the intake guide wall includes a plurality of thinned concave parts separated by a plurality of ribs provided between the concave parts.

3 Claims, 12 Drawing Sheets

INTAKE MANIFOLD FOR ENGINE

CROSS-REFERENCE TO RELATED APPLICATIONS

The present invention claims priority under 35 USC §119 based on Japanese patent application No. 2007-262236 filed 5 Oct. 2007. The subject matter of this priority document is incorporated by reference herein.

BACKGROUND OF THE INVENTION

1. Field of the Invention

The present invention relates to an improvement in an intake manifold for an engine, comprising: a plurality of intake distribution pipes arranged in a side-by-side relation to one another along one side wall; an intake inlet pipe provided in one end wall in a direction of arrangement of the intake distribution pipes; a surge chamber provided inside the intake manifold, and providing communication between the intake inlet pipe and the intake distribution pipes; and an intake guide wall provided integrally with the intake manifold, the intake guide wall extending in the direction of arrangement of the intake distribution pipes from an opening end of the intake inlet pipe, which is open to the surge chamber, to an intermediate portion of the surge chamber, and formed to temporarily guide the air, which has been introduced from the intake inlet pipe into the surge chamber, to a middle portion of the surge chamber.

2. Description of the Related Art

Such an intake manifold for an engine has been already known as disclosed, for example, in Japanese Patent Application Laid-open 2002-361745.

This conventional type of intake manifold for an engine includes an intake guide wall which is formed relatively thick to have a higher rigidity so that it is prevented from vibrating even when receiving intake pulsations from the surge chamber. However, for the purpose of reducing the weight of the engine as much as possible, there is a requirement to form the intake guide wall thinner. If the intake guide wall is merely formed thinner, the intake guide wall will then have a reduced rigidity and as a result, it will generate vibration noise.

SUMMARY OF THE INVENTION

The present invention has been made with the foregoing conditions taken into consideration. An object of the present invention is to provide an intake manifold for an engine which achieves both the demands to make the intake guide wall thin and secure its rigidity, and which is further capable of reducing resistance of air taken into the engine by smoothly guiding the air to a middle portion of the surge chamber.

In order to achieve the above-described object, according to a first feature of the present invention, there is provided an intake manifold for an engine, comprising: a plurality of intake distribution pipes arranged in a side-by-side relation to one another along one side wall; an intake inlet pipe provided in one end wall in a direction of arrangement of the intake distribution pipes; a surge chamber provided inside the intake manifold, and providing communication between the intake inlet pipe and the intake distribution pipes; and an intake guide wall provided integrally with the intake manifold, the intake guide wall extending in the direction of arrangement of the intake distribution pipes from an opening end of the intake inlet pipe, which is open to the surge chamber, to an intermediate portion of the surge chamber, and formed to temporarily guide the air, which has been introduced from the intake inlet pipe into the surge chamber, to a middle portion of the surge chamber, characterized in that one of opposite side surfaces of the intake guide wall is formed as a smooth-and-flat surface which is continuous to an inner surface of the intake inlet pipe, and the other side surface of the intake guide wall, which is on the side of the intake distribution pipes, is provided with a plurality of thinned concave parts and a plurality of ribs remaining between the concave parts, the ribs extending in a height direction of the intake guide wall.

With the above configuration, the air flowing into the intake inlet pipe is guided smoothly to reach the middle portion of the surge chamber without reduction in pressure by the smooth-and-flat surface located on one side of the intake guide wall, the smooth-and-flat surface being continuous to the inner surface of the intake inlet pipe. For this reason, regardless of whether the distance between the intake inlet pipe and each of the multiple side-by-side arranged intake distribution pipes is long or not, the above configuration allows the air to be substantially equally distributed to the multiple intake distribution pipes from the middle portion of the surge chamber. Thereby, the above configuration can contribute to increasing the engine output, and effectively prevent generation of intake noises due to turbulent flow of the intake air. Moreover, the multiple thinned concave portions in the other side surface of the intake guide wall enables the intake guide wall to be thinner, and the multiple ribs increase the rigidity of the intake guide wall. Accordingly, the intake guide wall is prevented from causing vibration noises due to the pressure pulsation of the intake air in the surge chamber. Consequently, the intake guide wall can exhibit a suitable intake guiding function while achieving both the demands to make the intake guide wall thin and secure its rigidity. Furthermore, thinning the intake guide wall contributes to a reduction in the amount of materials to be used, as well as to a reduction in manufacturing costs.

According to a second feature of the present invention, in addition to the first feature, the intake manifold is formed of a first manifold half body made of a synthetic resin and a second manifold half body made of a synthetic resin, the first manifold half body including at least the plurality of intake distribution pipes and a half section of the surge chamber, the second manifold half body including at least the other half section of the surge chamber, and the first manifold half body and the second manifold half body being welded to each other, and the intake guide wall comprises a first half section integrally formed in the first manifold half body, and a second half section integrally formed in the second manifold half body, the first and second half sections of the intake guide wall being welded to each other at opposed joint surfaces thereof.

With the above configuration, the first and second half sections of the intake guide wall can be welded together simultaneously when the first and second manifold half bodies are welded together, and therefore the intake guide wall can be made strong. With this configuration, the rigidity of the intake manifold is increased.

According to a third feature of the present invention, in addition to the second feature, the plurality of thinned concave parts are formed in at least one of the first and second half sections of the intake guide wall such that end portions respectively of the plurality of thinned concave parts are terminated before reaching the joint surfaces of the half sections.

With the above configuration, reduction in the welded area in which the first and second half sections of the intake guide wall are welded together due to the thinned concave parts can be avoided, and accordingly the strength with which the two half sections are welded together can be increased.

The above-described and other object, characteristics, advantages of the present invention will be clear through detailed descriptions which will be provided below for the preferred embodiment referring to the attached drawings.

BRIEF DESCRIPTION OF THE DRAWINGS

FIG. 1 is a plan view of an intake manifold for an engine.

FIG. 2 is a left side view of the intake manifold.

FIG. 3 is a bottom view of the intake manifold.

FIG. 4 is a plan view of a first manifold half body of the intake manifold, which is viewed from the inside thereof.

FIG. 5 is a plan view of a second manifold half body of the intake manifold, which is viewed from the inside thereof.

FIG. 6 is a plan view shown in FIG. 5 with an essential part being broken away.

FIG. 7 is a cross-sectional view taken along a line 7-7 in FIG. 3.

FIG. 8 is a cross-sectional view taken along a line 8-8 in FIG. 3.

FIG. 9 is a cross-sectional view taken along a line 9-9 in FIG. 3.

FIG. 10 is a view from an arrow 10 in FIG. 9.

FIG. 11 is a cross-sectional view taken along a line 11-11 in FIG. 3.

FIG. 12 is a cross-sectional view taken along a line 12-12 in FIG. 3.

DESCRIPTION OF THE PREFERRED EMBODIMENT

Descriptions will be provided for an embodiment of the present invention on the basis of the example of the present invention shown in the attached drawings.

Figure 1:
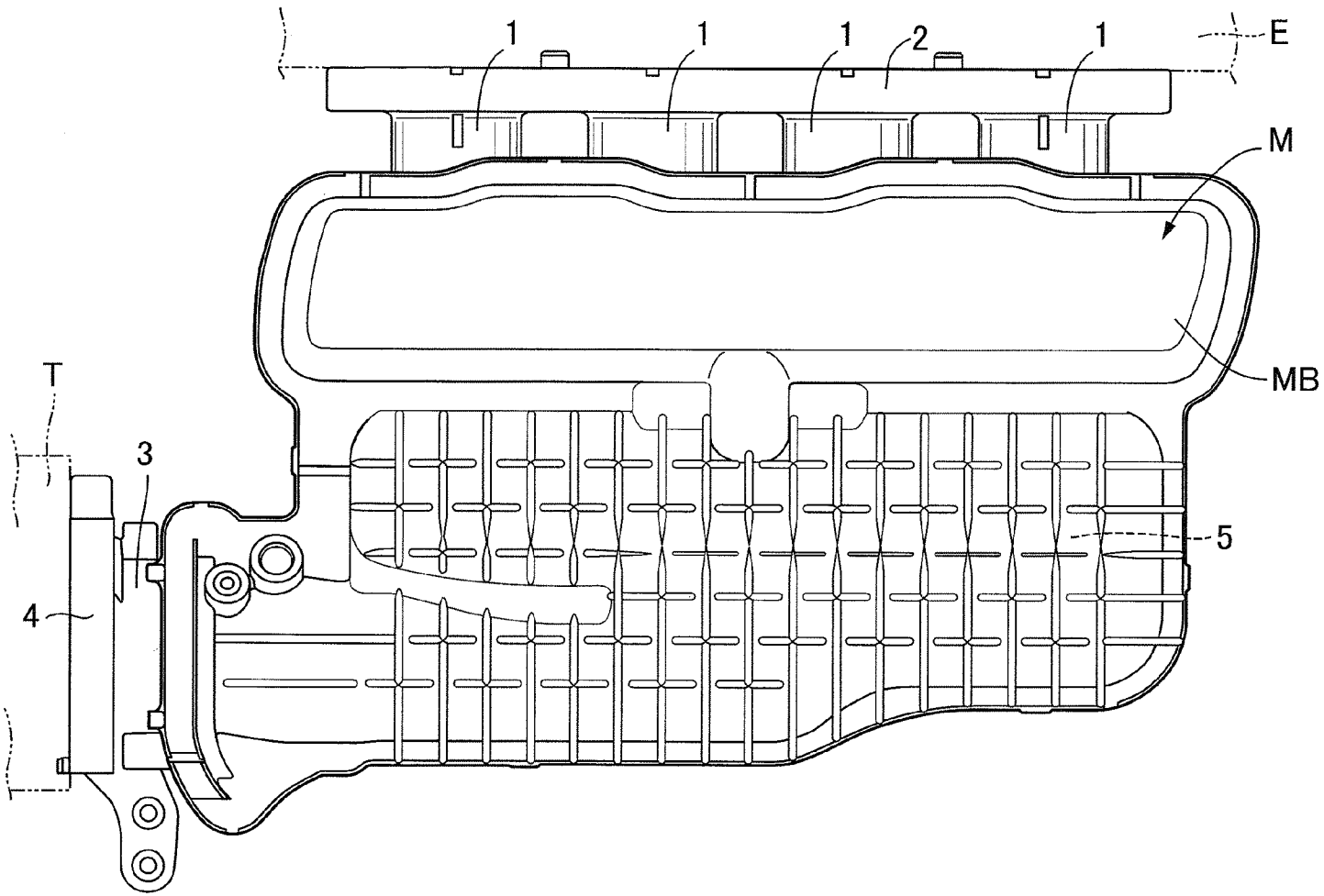
FIGS. 1 to 12 show a first example of the present invention.
Figure 2:
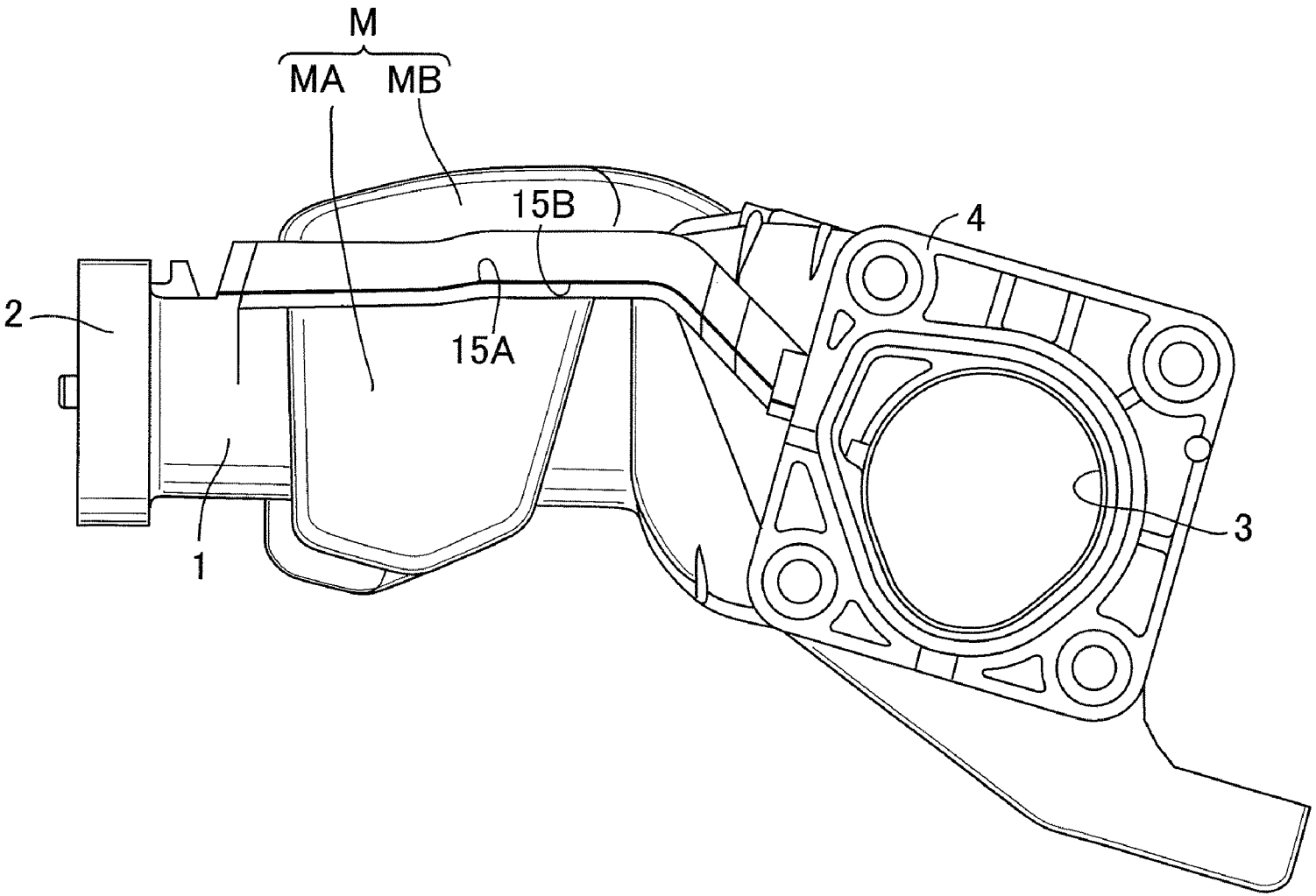
Figure 3:
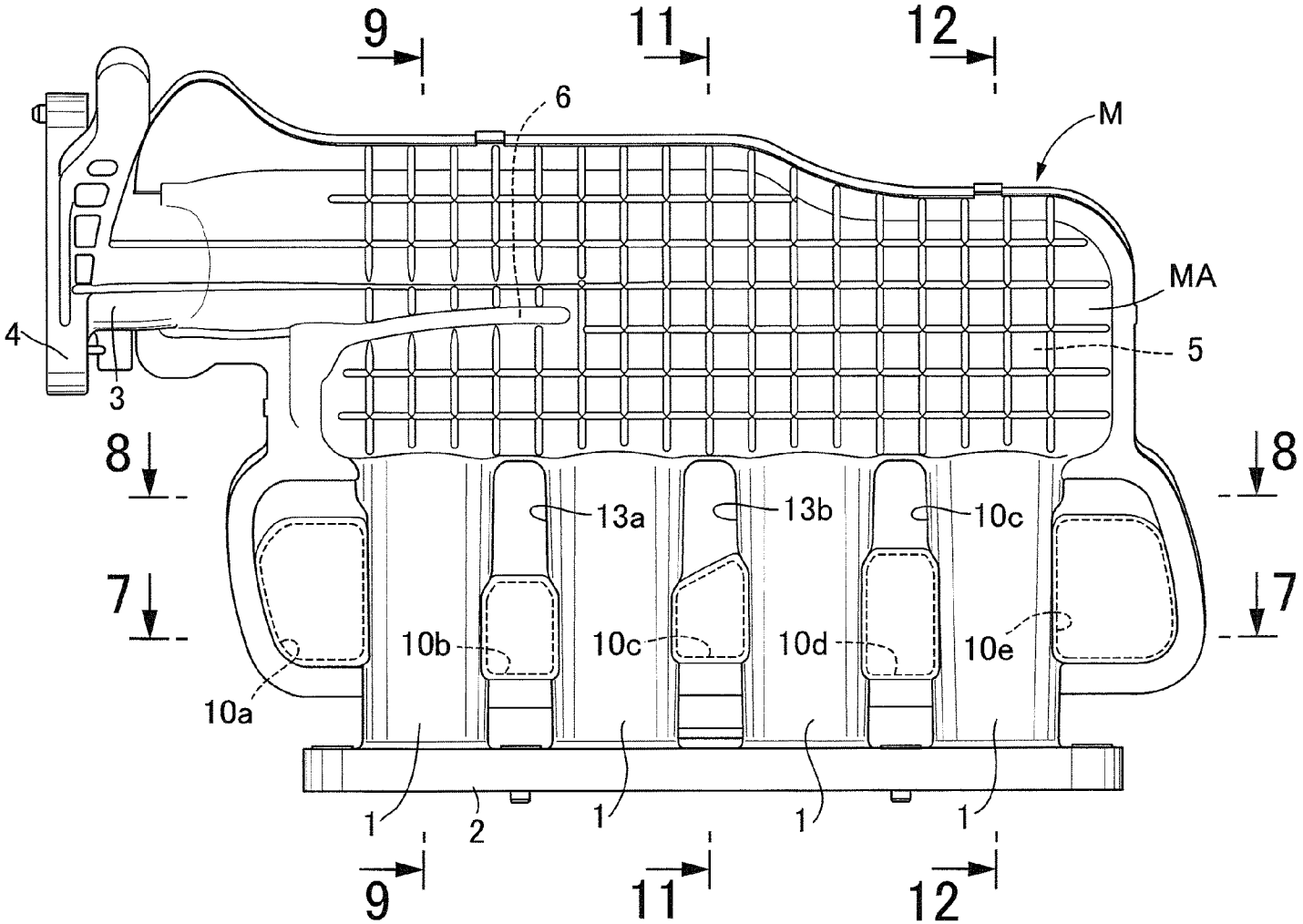

First of all, in FIGS. 1 to 3, reference numeral M denotes an intake manifold for a 4-cylinder engine E mounted on an automobile. This intake manifold M is shaped like a box whose longitudinal direction coincides with the left-right direction in FIG. 1. Four intake distribution pipes 1, 1 . . . which are arranged in a side-by-side relation to one another are formed along a side wall extending in the longitudinal direction. A common mounting flange 2 is integrally formed in the downstream ends of the intake distribution pipes 1, 1 . . . so as to integrally connect the intake distribution pipes 1, 1 . . . together. This mounting flange 4 is designed to be fixed to the engine E with multiple bolts.

An intake inlet pipe 3 is integrally formed in an end wall of the intake manifold M in a direction of arrangement of the four intake distribution pipes 1, 1 . . . . A square mounting flange 4 is integrally formed in the upstream of this intake inlet pipe 3. A throttle body T is designed to be attached to this mounting flange 4 with multiple bolts.

As shown in FIGS. 4 to 9, the inside of the intake manifold M constitutes a surge chamber 5 through which the intake inlet pipe 3 communicates with the four intake distribution pipes 1, 1 . . . . In the surge chamber 5, provided is an intake guide wall 6 which extends, in the direction of arrangement of the intake distribution pipes 1, 1 . . . , from an end edge of a side of the intake distribution pipes 1, 1 . . . in an opening end of the intake inlet pipe 3 which opens to the surge chamber 5 and reaches the substantially middle portion of the surge chamber 5. As clearly shown in FIGS. 4 to 6, this intake guide wall 6 is slightly tilted to an axis X of the intake inlet pipe 3 so as to be gradually away from the intake distribution pipes 1, 1 . . . toward the inside of the surge chamber 5. In addition, a first side surface of the intake guide wall 6 which is on an opposite side of the intake distribution pipes 1, 1 . . . is formed as a smooth-and-flat surface 6*a* which is continuous to the inner peripheral surface of the intake inlet pipe 3.

Figure 4:
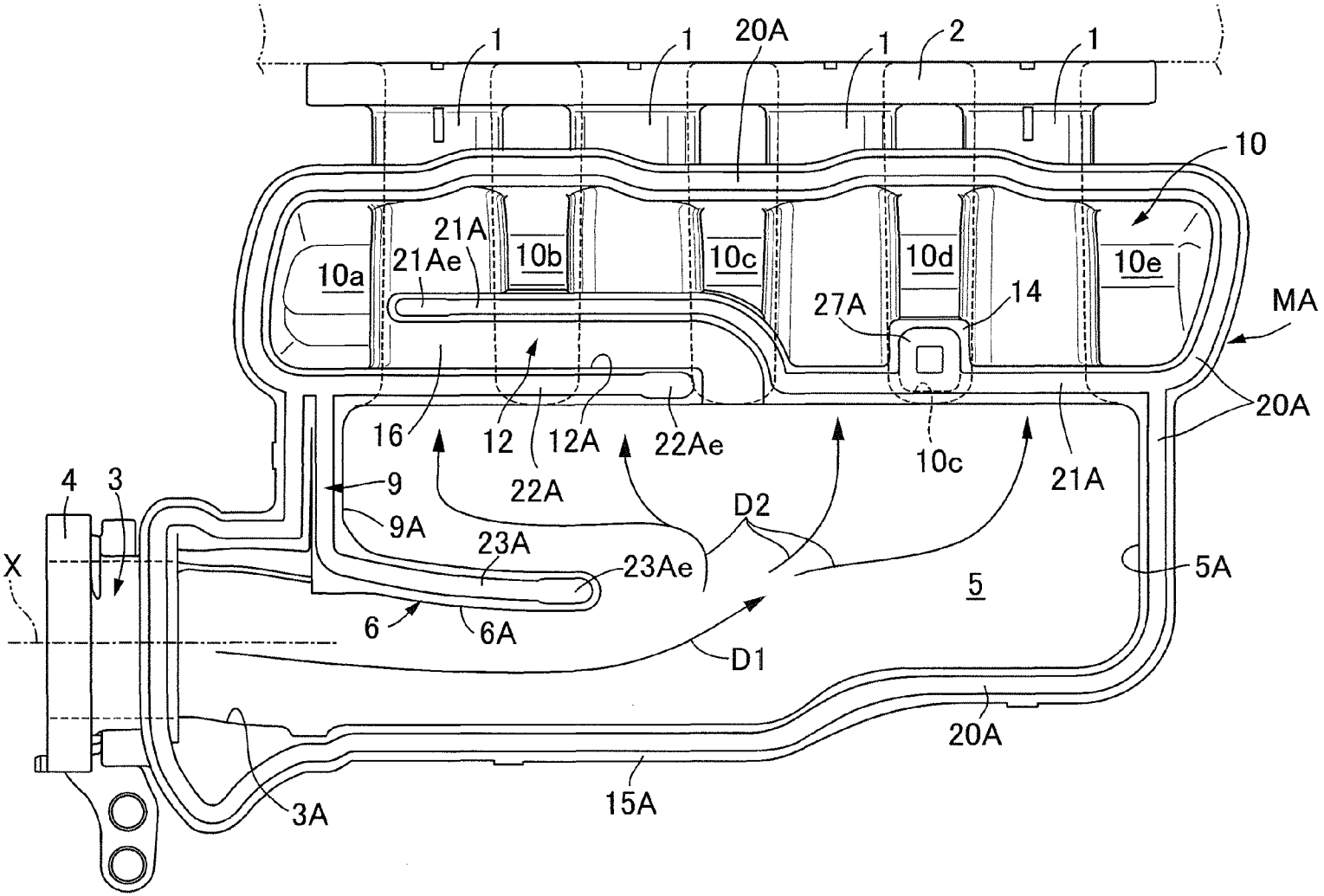
Figure 5:
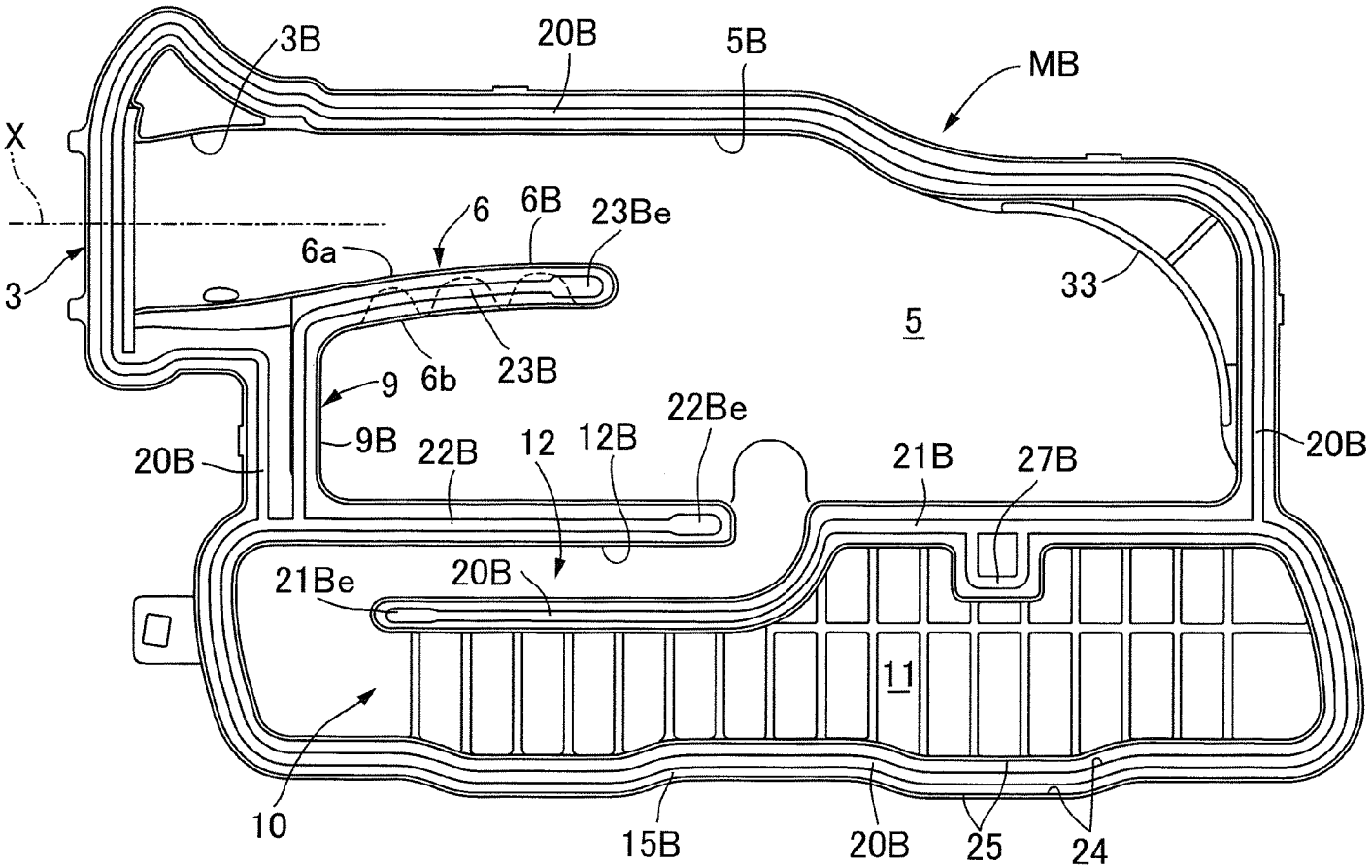
Figure 6:
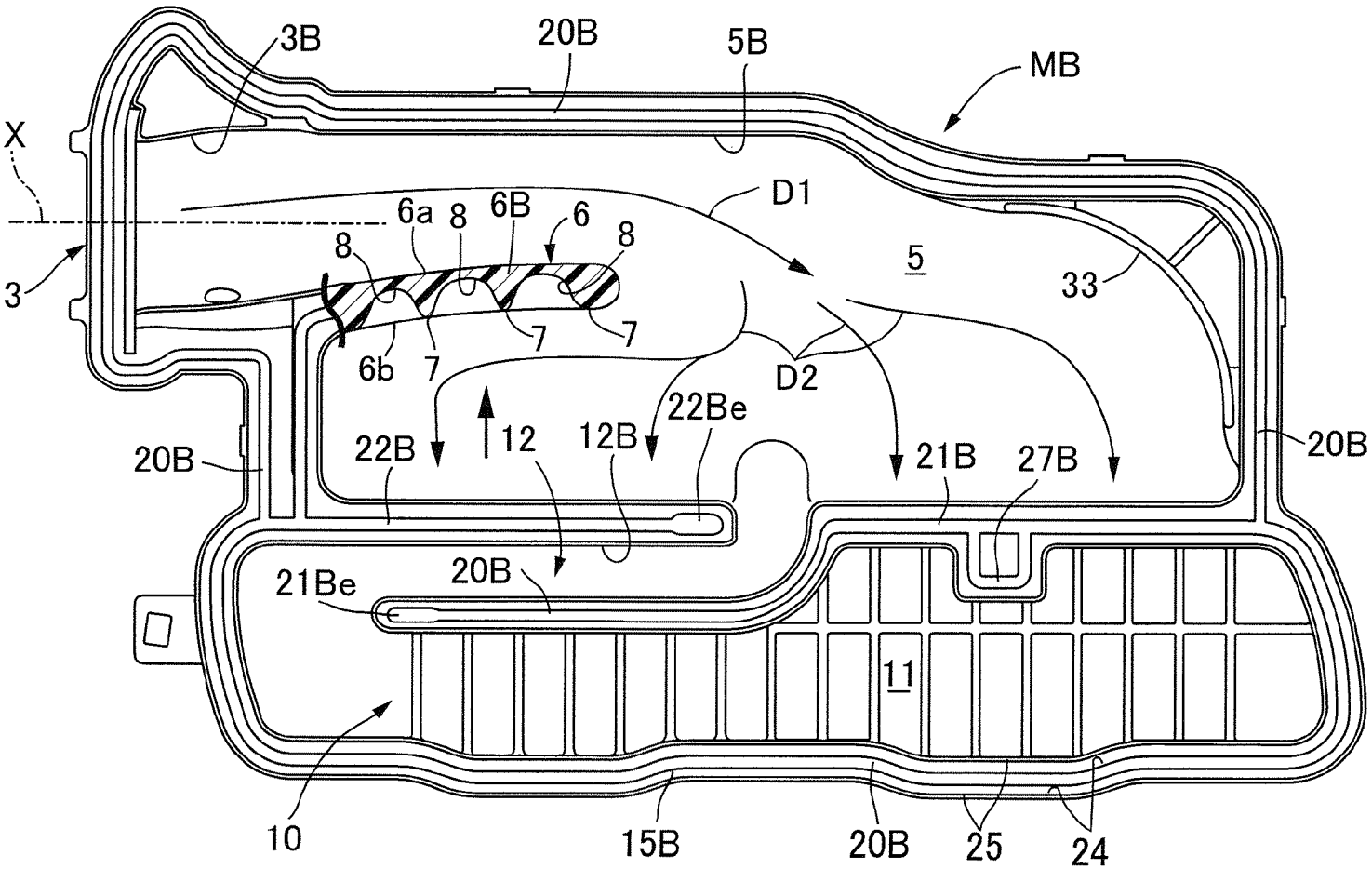
Figure 7:
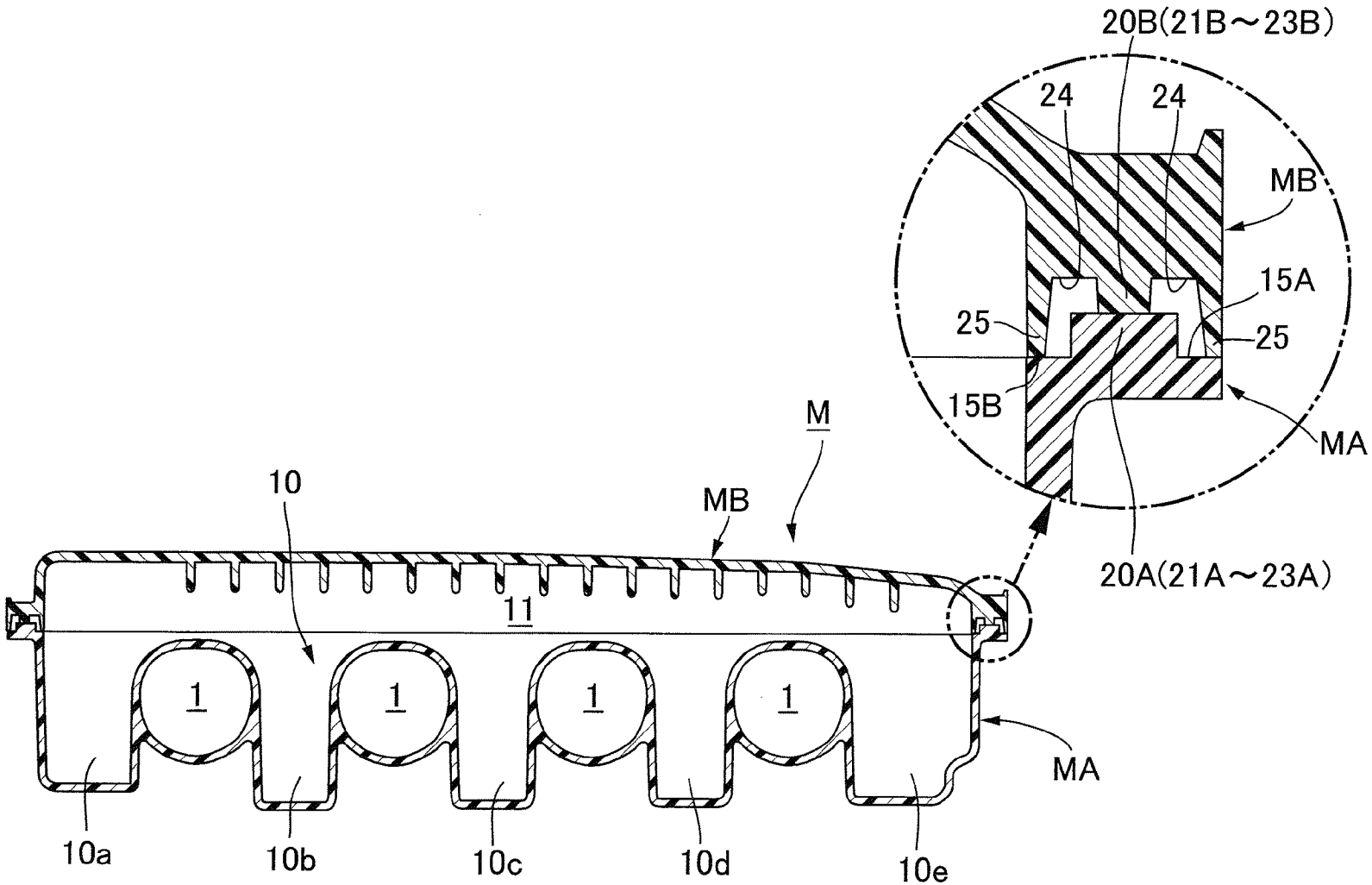

As shown with an arrow D1 in FIGS. 4 and 6, the air flowing into the intake inlet pipe 3 in conjunction with the intake operation of the engine is smoothly guided by the smooth-and-flat surface 6*a* of the intake guide wall 6 which is continuous to the inner surface of the intake inlet pipe 3. Thereby, the air can reach the middle portion of the surge chamber 5 without its reduction in pressure. Consequently, regardless of the length of the distance between the intake inlet pipe 3 and each of the four side-by-side arranged intake distribution pipes 1, 1 . . . , as shown with an arrow D2 in FIGS. 4 to 6, the air is substantially equally distributed among the four intake distribution pipes 1, 1 . . . after passing the middle portion of the surge chamber 5. This enhances the efficiency of taking air in each cylinder of the engine E, and thus contributes to increasing the engine output. This also can effectively prevent generation of intake noises due to turbulent flow of the intake air.

Figure 9:
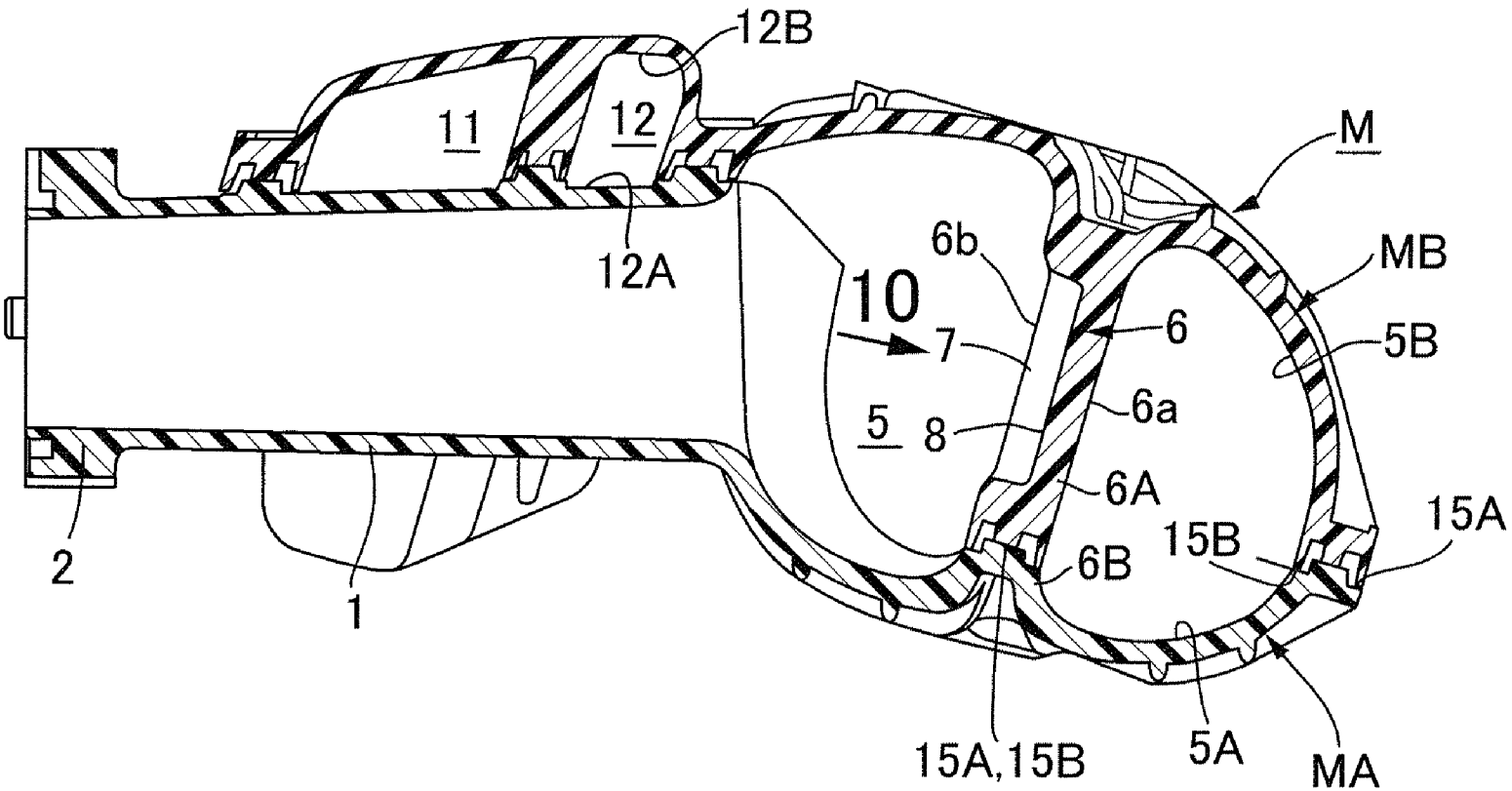
Figure 10:
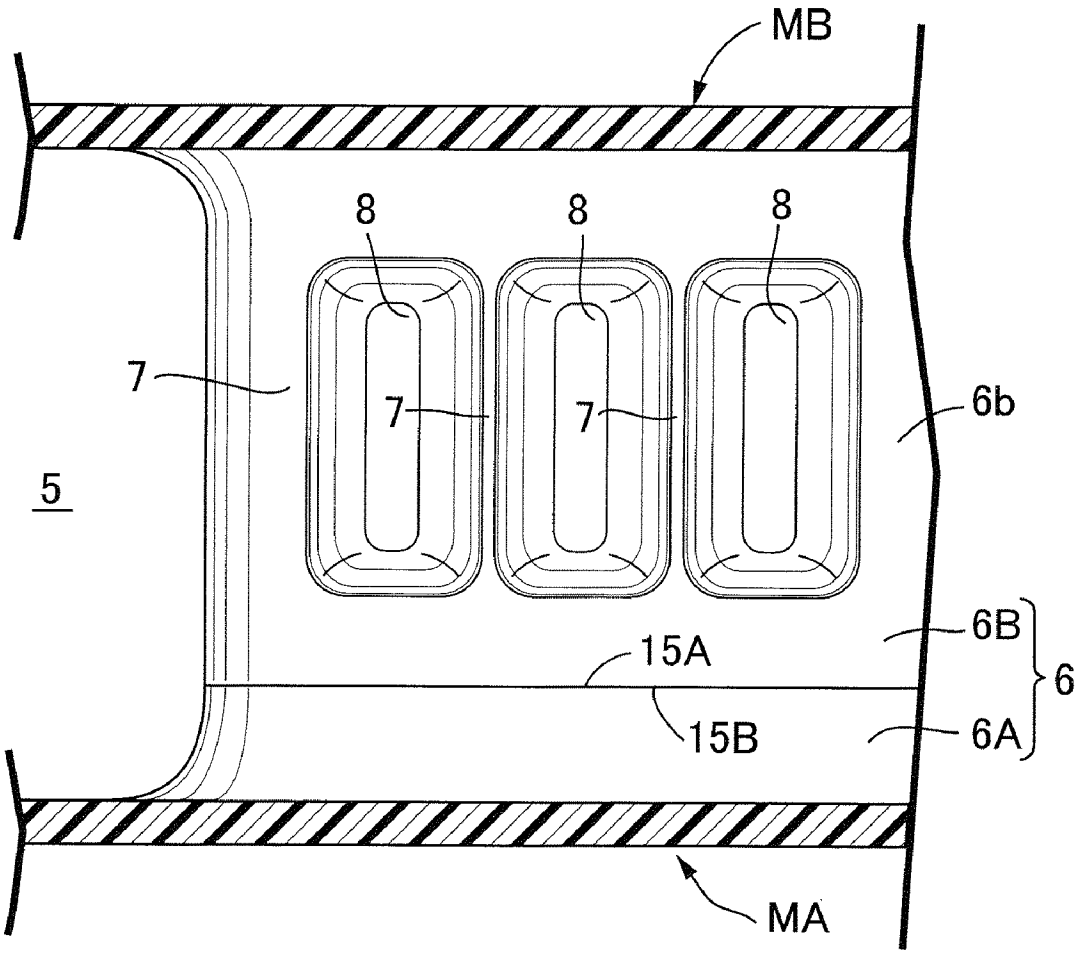

As shown in FIGS. 6, 9 and 10, multiple thinned concave parts 8, 8 . . . are formed in a second side surface 6*b* of the intake guide wall 6, which is on the side of the intake distribution pipes 1, 1 . . . , with multiple ribs 7, 7 . . . left therebetween. The multiple ribs 7, 7 . . . extend in the upward-downward direction, and are arranged in parallel with one another at intervals. A reinforcing wall 9 is integrally continuously formed in the intake inlet pipe 3 side end portion of the intake guide wall 6. The reinforcing wall 9 extends so as to be at right angles to the intake guide wall 6.

The formation of the multiple thinned concave parts 8, 8 . . . makes the intake guide wall 6 thin. Concurrently, the construction of the multiple ribs 7, 7 . . . reinforces the rigidity of the intake guide wall 6. Consequently, it is possible to prevent the intake guide wall 6 from causing vibration noises due to the pressure pulsation of the intake air in the surge chamber 5. In addition, the second side surface 6*b* of the intake guide wall 6, which is on the side of the intake distribution pipes 1, 1 . . . , has almost no relation to the guide function of the air flow. For this reason, the ribs 7, 7 . . . and the thinned concave parts 8, 8 . . . formed in the second side surface 6*b* thereof cause the merest of intake air resistance. Consequently, it is possible to cause the intake guide wall 6 to exert a suitable intake guide function, and concurrently to achieve both the demands to make the intake guide wall thin and secure its rigidity. Furthermore, the intake guide wall formed thinner can reduce the amount of a material to be used, that is a synthetic resin, which is used for the intake manifold M, and contribute to reduction of manufacturing costs.

As shown in FIGS. 4 to 9, the intake manifold M further includes, inside thereof, a resonator chamber 10 communicating with the surge chamber 5 through a communication path 12. The resonator chamber 10 comprises: three small resonator chambers 10*b* to 10*d* each formed between adjacent two of the four intake distribution pipes 1, 1 . . . ; two small resonator chambers 10*a*, 10*e* formed in the respective two outer sides of the group consisting of the intake distribution pipes 1, 1 . . . ; and a flat communication chamber 11 through which the total 5 small resonator chambers 10*a* to 10*e* communicate with each other. The small resonator chamber 10*a* located in one of the two outer sides thereof communicates with the middle portion of the surge chamber 5 through the communication path 12. At this time, each of the small resonator chambers 10*a* to 10*e* is formed to protrude downward lower than the undersurfaces of its adjacent intake distribution pipes 1, 1 . . . in order to secure the volume of each small chamber as large as possible. The resonator chamber 10 thus configured is capable of reducing intake noises generated in the surge chamber 5 within a predetermined frequency band, and contributes to increase of the engine torque.

Similarly, as shown in FIGS. 4 to 9, the intake manifold M includes: a first manifold half body MA constituting the lower half thereof; and a second manifold half body MB constituting the upper half thereof, each being separately formed of a synthetic resin. Both the manifold half bodies MA, MB are jointed together by welding their mutually-opposing joint surfaces 15A, 15B through friction of vibrations.

The first manifold half body MA includes: the mounting flange 2; a first half section 3A of the intake inlet pipe 3; a first half section 5A of the surge chamber 5; a first half section 6A of the intake guide wall 6; the group consisting of the intake distribution pipes 1, 1 . . . ; the mounting flange 2; the group consisting of the small resonator chambers 10*a* to 10*e*; and a shallow, first concave groove 12A which constitutes a first half section of the communication path 12. On the other hand, the second manifold half body MB includes: a second half section 3B of the intake inlet pipe 3; a second half section 5B of the surge chamber 5; a second half section 6B of the intake guide wall 6; the communication chamber 11; a deep, second concave groove 12B constituting a second half section of the communication path 12; and a second half section 9B of the reinforcing wall 9.

In the undersurface of the first manifold half body MA, formed are three concave parts 13*a* to 13*c* each surrounded by the surge chamber 5, the four intake distribution pipes 1, 1 . . . , and the respective intermediate three small resonator chambers 10*b* to 10*d*. Out of the three concave parts 13*a* to 13*c*, the ceiling walls of two concave parts 13*a*, 13*b* which are adjacent on the side of the intake inlet pipe 3 continue to the pipe walls of the respective two intake distribution pipes 1, 1 being adjacent to the these concave parts 13*a*, 13*b*, and thus constitute an flat wall 16. The shallow concave groove 12A is formed in this flat wall 16.

The first half section 6A of the intake guide wall 6 is formed of a small height. The second half section 6B thereof is formed of a large height. The multiple ribs 7, 7 . . . and the multiple thinned concave parts 8, 8 . . . are provided in the second half section 6B thereof. The lower ends of the respective thinned concave parts 8, 8 . . . are terminated before reaching the lower end surface of the second half section 6B thereof, that is to say, the joint surface 15B (see FIGS. 9 and 10 particularly). Accordingly, when the first and second manifold half bodies MA, MB are welded to each other, this design makes it possible to simultaneously weld together the first half section 6A and the second half section 6B of the intake guide wall 6, so that the intake guide wall 6 can be made strong. This achieves the increase in rigidity of the intake manifold M. Furthermore, the two half sections 6A, 6B of the intake guide wall 6 can be welded to each other with the increased strength while avoiding the welded area of both the half sections 6A, 6B from being decreased due to the formation of the thinned concave parts 8, 8 . . . .

In the mutually-opposing joint surfaces 15A, 15B of the first and second manifold half body MA, MB, respectively formed are: first welded beads 20A, 20B which are endless, and encompass a part of the intake inlet pipe 3 and the entire surge chamber 5 and the entire resonator chamber 10; second welded beads 21A, 21B which have an end, and extend from the respective first welded beads 20A, 20B along a first side wall of the resonator chamber 10 and a first side wall of the communication path 12; third welded beads 22A, 22B which have an end and extend from the respective first welded beads 21A, 21B along a second side wall of the communication path 12; and fourth welded beads 23A, 23B which have an end and extend from the adjacent portion in which the third welded beads 22A, 22B are close to the first welded beads 21A, 22B along the reinforcing wall 9 and the intake guide wall 6.

In addition, in the joint surface 15B of the second manifold half body MB, paired restriction walls 25, 25 (see FIG. 7) are formed on the two sides of each of the first to fourth welded beads 20B to 23B in the width direction. The restriction walls 25, 25 extend upright with grooves 24, 24 being interposed in between.

Referring to FIGS. 4 and 5, in the second to fourth welded beads 21A to 23A of the first manifold half body MA, the widths of the end parts 21Ae to 23Ae are set to be larger than those of any other chief portions, respectively. In the second to fourth welded beads 21B to 23B of the second manifold half body MB, the widths of the end parts 21Be to 23Be are set to be larger than those of any other chief portions, respectively.

Furthermore, out of the three concave parts 13*a* to 13*c* of the first manifold half body MA, the concave part 13*a* has no relation with the formation of the flat wall 16. The upper surface of the ceiling wall 16 of the concave part 13*a* is continuous to the joint surface on the side of the first manifold half body MA. A reinforcement welded bead 27A is formed, on the upper surface of the ceiling wall 16 of this concave part 13*a*, in a closed square shape in cooperation with an intermediate portion of the second welded bead 21A which has an end. Correspondingly, a reinforcement welded bead 27B is also formed in the joint surface 15B of the second manifold half body MB. In addition, a part of the restriction wall 25 is extended so as to surround the reinforcement welded bead 27B.

Figure 8:
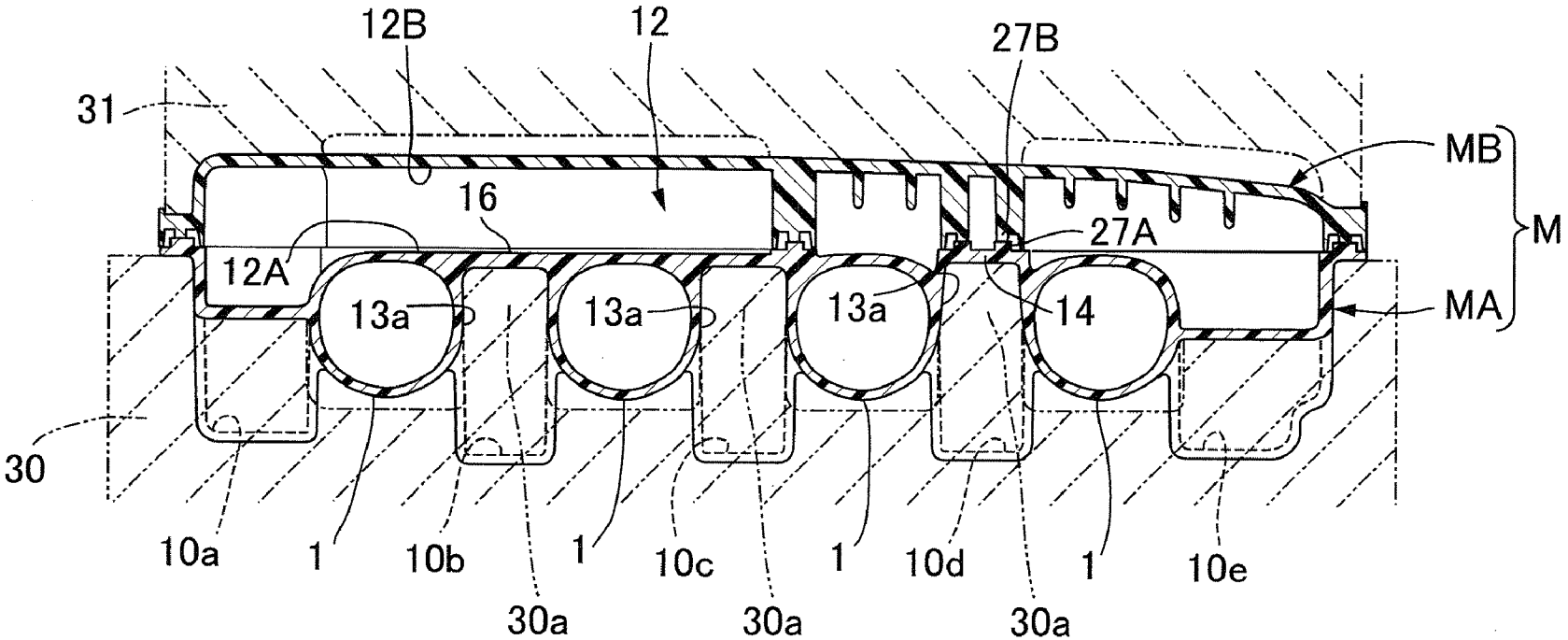
Figure 11:
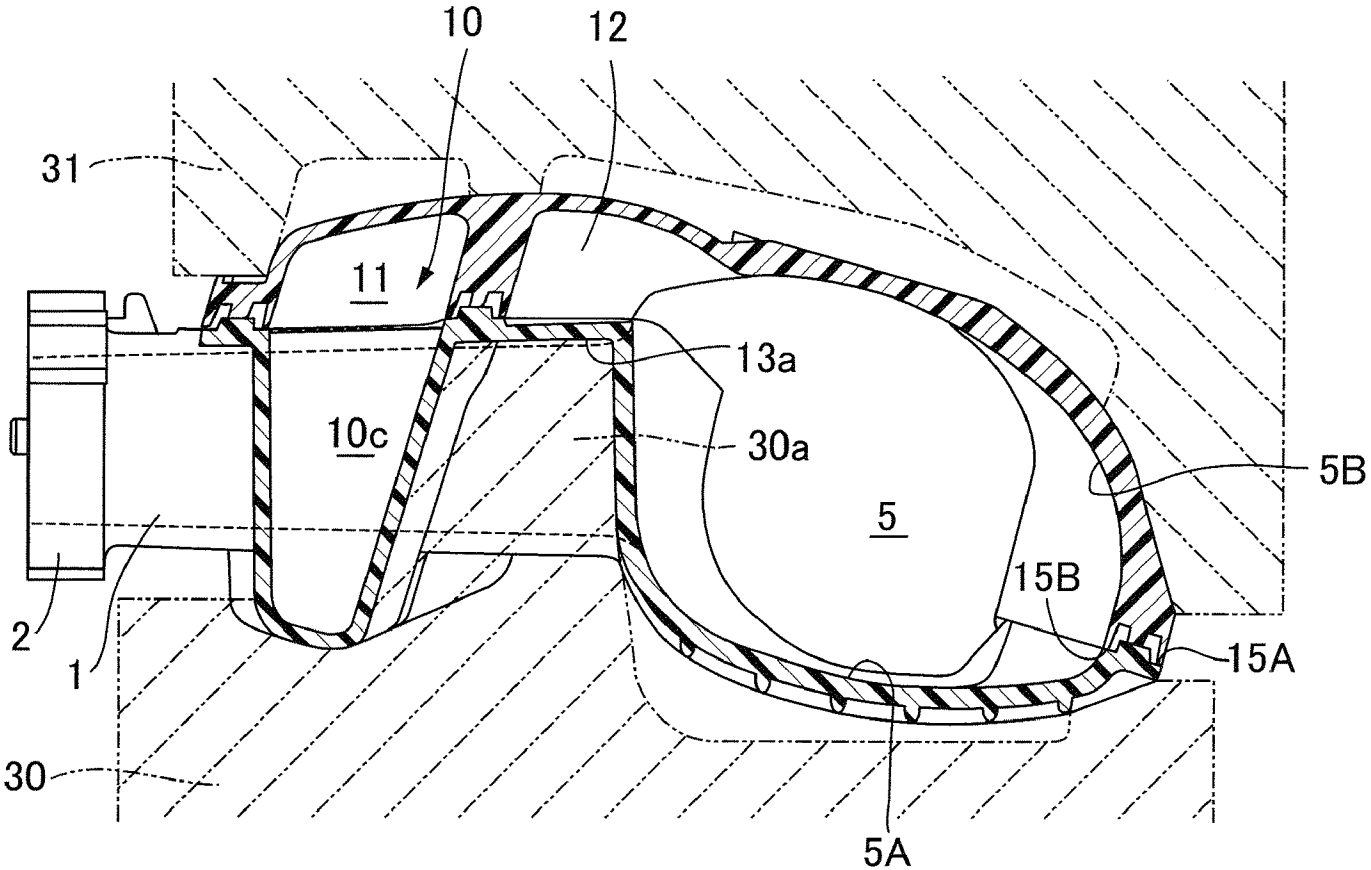

As shown in FIGS. 8 and 11, welding together the joint surfaces 15A, 15B of the first and second manifold half bodies MA, MB will be performed as follows. The first manifold half body MA is placed on a supporting base 30 with its joint surface 15A being faced upward. Thus, the welded beads 20B to 22B, 27B of the joint surface 15B of the second manifold half body MB are overlapped on the welded beads 20A to 22A, 27A of the joint surface 15A of the first manifold half body MA. Subsequently, a pressing vibration jig 31 for pressing the second manifold half body MB from above is vibrated in the longitudinal direction of the intake manifold M.

At this time, the supporting base 30 includes: a regular backup part for supporting the periphery of the lower surface of the first manifold half body MA; and particularly three backup protrusions 30*a* to 30*c* in the substantially middle portion of the supporting base 30. These backup protrusions 30*a* to 30*c* engage with the three concave parts 13*a* to 13*c* which are formed on the undersurface of the first manifold half body MA, and which are surrounded by the surge chamber 5, the four intake distribution pipes 1, 1 . . . , and the three intermediate small resonator chambers 10*b* to 10*d*. Thereby, the backup protrusions 30*a* to 30*c* are in contact with the ceiling surfaces of the three concave parts 13*a* to 13*c*. Accordingly, the backup protrusions 30*a* to 30*c* of the supporting base 30 prevent the middle portions respectively of the first and second manifold half bodies MA, MB from deflecting when the pressing vibration jig 31 is vibrated with the second manifold half body MB being pressed from above. This prevention makes it possible to securely weld the first and second manifold half bodies MA, MB together by generating frictional heat equally not only between the first welded beads 20A, 20B on the periphery of the intake manifold M but also between the intermediate second to fourth welded beads 21A to 22A and the respective intermediate second to fourth welded beads 21B to 22B. The overlap width for the welding is restricted by the contact of the restriction walls 25 of the second manifold half body MB onto the joint surface 15A of the first manifold half body MA. In addition, flashes produced while welding is contained in the grooves 24 located among the restriction walls 25 and the welded beads.

As described above, since the three concave parts 13*a* to 13*c* which are formed on the undersurface of the first manifold half body MA, and which are surrounded by the surge chamber 5, the four intake distribution pipes 1, 1 . . . , and the three intermediate small resonator chambers 10*b* to 10*d* are used as the engagement concave parts for engaging with the backup convex parts 30*a* to 30*c* of the supporting base 30, it is not necessary to form concave parts specialized for engaging with the backup convex parts 30*a* to 30*c* in the middle portion of the first manifold half body MA. For this reason, the supporting base 30 can strongly support the substantially middle portion of the first manifold half body MA without changing the original structure and shape of the first manifold half body MA, so that the welded portion between the two manifold half bodies MA, MB can be desirable. In the case illustrated by the drawings, particularly, the concave parts 13*a* to 13*c* with which the backup protrusions 30*a* to 30*c* engage are located substantially immediately under the second and third welded beads 21A, 22A of the first manifold half body MA. For this reason, the concave parts 13*a* to 13*c* strongly suppress deflection at the peripheral portions of the second and third welded beads the second and third welded beads 21A, 22A. This makes it possible to more securely weld together the second welded beads 21A, 21B as well as the third welded beads 22A, 22B whose locations vertically correspond to each other.

Moreover, in the second to fourth welded beads 21A to 23A of the first manifold half body MA, the widths of the end parts end parts 21Ae to 23Ae are set to be larger than those of any other chief portions, respectively. In the second to fourth welded beads 21B to 23B of the second manifold half body MB, the widths of the end parts end parts 21Be to 23Be are set to be larger than those of any other chief portions, respectively. For these reasons, it is possible to expand the welded area at the end parts 21Ae to 23Ae of the second to fourth welded beads 21A to 23A and the end parts 21Be to 23Be of the second to fourth welded beads 21B to 23B and thereby enhance the welded strength of those portions.

In the state where the intake manifold M is used, there is a tendency for concentrated stress to be generated particularly in the welded portion between the end parts of the respective second to fourth welded beads 21A to 23A and 21B to 23B having an end, due to the vibrations and the like of the engine E. However, it can securely prevent separation in their welded portions between the end parts of the second to fourth welded beads 21A to 23A and 21B to 23B due to the concentrated stress.

In addition, the reinforcement welded beads 27A, 27B which constitute the closed square shape in cooperation with the second welded beads 21A, 21B are provided so as to be continuous to the intermediate portion of the second welded beads 21A, 21B which is the longest among the second to fourth welded beads 21A to 23A having an end. Consequently, the welding together of the reinforcement welded beads 27A, 27B increases the welded strength with which the intermediate portions of the second welded beads 21A, 21B are welded together. This also makes it possible to securely prevent the welded portion of the intermediate portions of the second welded beads 21A, 21B from being separated from each other due to the vibrations.

Furthermore, the reinforcement welded bead 27A on the first manifold half body MA is formed on the upper surface of the ceiling wall 14 of the concave part 13*c* with which the backup protrusion 30*c* out of the protrusions engages by use of the ceiling wall 14. This locates the concave part 13*c* with which the backup protrusion 30*c* engages substantially immediately under the reinforcement welded bead 27A. It can strongly suppress deflection at the reinforcement welded bead 27A and its surround, and concurrently securely weld together the reinforcement welded beads 27A, 27B which vertically correspond to each other.

Figure 12:
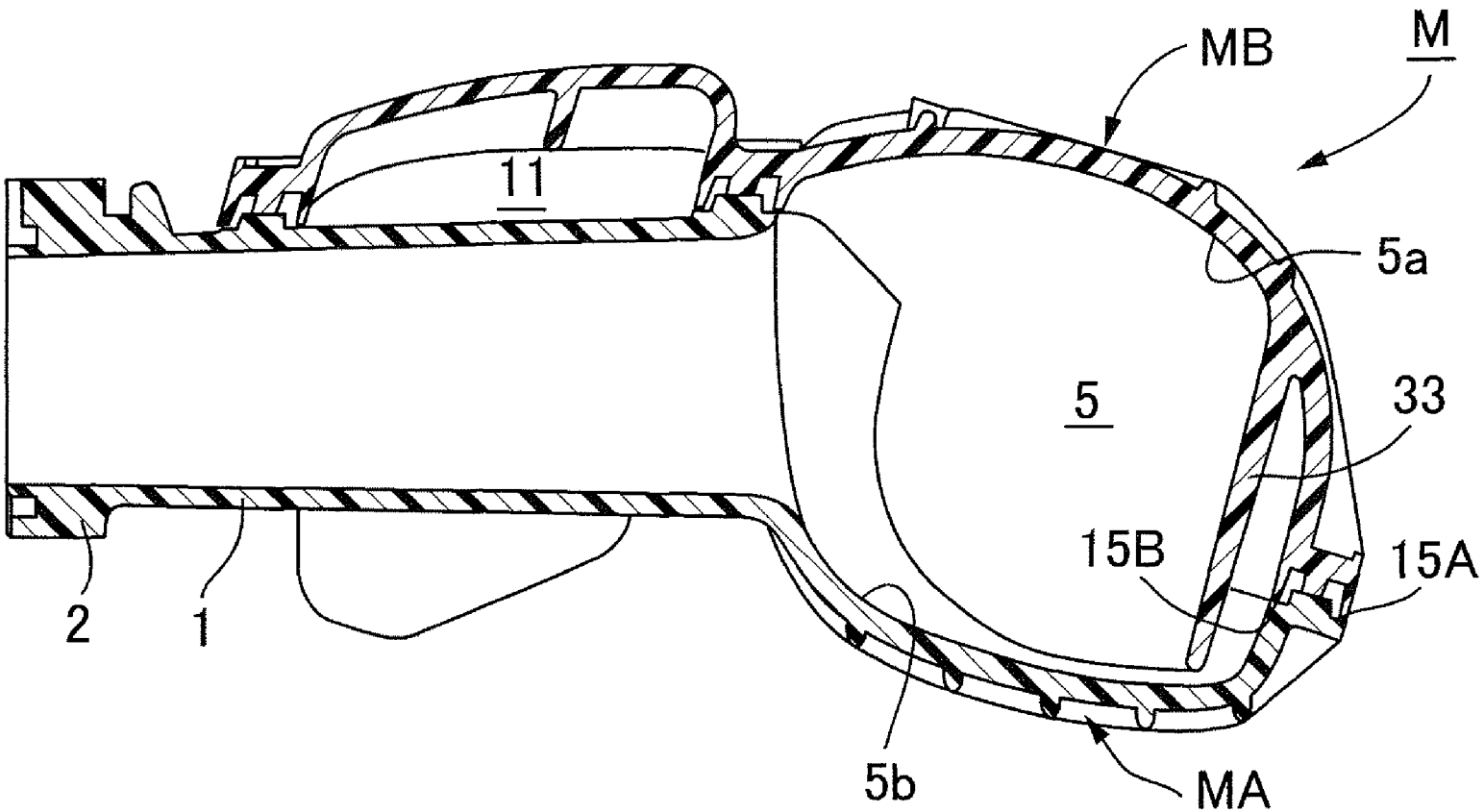

In the second manifold half body MB, as shown in FIGS. 5 and 12, a guide wall 33 is formed in a corner portion of the surge chamber 5 which is away from the intake inlet pipe 3. The guide wall 33 has an arc-shaped cross-section, and is designed to smoothly guide the air flow to an outermost side, which is away from the intake inlet pipe 3, of the intake distribution pipe 1.

The present invention is not limited to the foregoing embodiment. Various design modifications can be applicable to the present invention without departing from the subject matter of the present invention. For example, the present invention can be applied to multiple-cylinder engines each having other than four cylinders. In addition, ribs 7 and thinned concave parts 8 may be formed in each of the second side walls 6*b* of the first half section 6A and the second half section 6B of the intake guide wall 6 by forming the first half section 6A and the second half section 6B with the substantially same height.

The invention claimed is:

1. An intake manifold for an engine, comprising:

a plurality of intake distribution pipes arranged in a side-by-side relation to one another along one side wall;

an intake inlet pipe provided in one end wall in a direction of arrangement of the intake distribution pipes;

a surge chamber provided inside the intake manifold, and providing communication between the intake inlet pipe and the intake distribution pipes; and an intake guide wall provided integrally with the intake manifold, the intake guide wall extending in the direction of arrangement of the intake distribution pipes from an opening end of the intake inlet pipe, which is open to the surge chamber, to an intermediate portion of the surge chamber, and formed to guide the air, which has been introduced from the intake inlet pipe into the surge chamber, to a middle portion of the surge chamber, wherein one of opposite side surfaces of the intake guide wall is smooth-and-flat and is continuous to an inner surface of the intake inlet pipe, and the other side surface of the intake guide wall, which is on the side of the intake distribution pipes, includes a plurality of thinned concave parts and a plurality of ribs remaining between the concave parts, the ribs extending in a height direction of the intake guide wall.

2. The intake manifold for an engine according to claim 1, wherein the intake manifold is formed of a first manifold half body made of a synthetic resin and a second manifold half body made of a synthetic resin, the first manifold half body including at least the plurality of intake distribution pipes and a half section of the surge chamber, the second manifold half body including at least the other half section of the surge chamber, and the first manifold half body and the second manifold half body being welded to each other, and the intake guide wall comprises a first half section integrally formed in the first manifold half body, and a second half section integrally formed in the second manifold half body, the first and second half sections of the intake guide wall being welded to each other at opposed joint surfaces thereof.

3. The intake manifold for an engine according to claim 2, wherein the plurality of thinned concave parts are formed in at least one of the first and second half sections of the intake guide wall such that end portions respectively of the plurality of thinned concave parts are terminated before reaching the joint surfaces of the half sections.

* * * * *